US005306099A

United States Patent [19]

Mason

[11] Patent Number: 5,306,099

[45] Date of Patent: * Apr. 26, 1994

[54] MINE TUNNEL SUPPORT SYSTEM

[75] Inventor: Benjamin Mason, Notts, Great Britain

[73] Assignee: Caledonian Mining Company Limited, Great Britain

[ * ] Notice: The portion of the term of this patent subsequent to Jan. 5, 2010 has been disclaimed.

[21] Appl. No.: 878,819

[22] Filed: May 5, 1992

Related U.S. Application Data

[63] Continuation-in-part of Ser. No. 784,170, Oct. 28, 1991, Pat. No. 5,176,474.

[30] Foreign Application Priority Data

Oct. 29, 1990 [GB] United Kingdom ..... 9023502

[51] Int. Cl.[5] ..... E21D 15/44

[52] U.S. Cl. ..... 405/299; 405/291; 405/303

[58] Field of Search ..... 405/259.1, 288, 290, 405/291, 297, 299, 300, 303

[56] References Cited

U.S. PATENT DOCUMENTS

| | | | |
|---|---|---|---|
| 3,811,290 | 5/1974 | Swoager | 405/299 |
| 4,143,991 | 3/1979 | Stafford | 405/291 |
| 4,307,982 | 12/1981 | Nelson | 405/299 X |
| 4,312,609 | 1/1982 | Culley, Jr. | 405/291 |
| 4,676,697 | 6/1987 | Stafford et al. | 405/291 |
| 5,176,474 | 1/1993 | Mason | 405/299 |

FOREIGN PATENT DOCUMENTS

| | | |
|---|---|---|
| 2415720 | 8/1979 | France . |
| 2203779 | 10/1988 | United Kingdom . |

*Primary Examiner*—David H. Corbin
*Attorney, Agent, or Firm*—Wood, Herron & Evans

[57] ABSTRACT

A mine tunnel support system of the type comprising spaced interconnected support sections is described. The support system is advanced along the tunnel in the forward direction in which mining is proceeding. Bolting machines may be carried on the support sections. A drill may be provided on one section and a bolt inserter provided on a section rearwardly thereof. As the system is advanced, the bolt inserter can insert a bolt into a hole previously formed by the drill. The operation of providing roof bolts is therefore split into a number of stages. A mechanism for erecting and/or pre-stressing permanent arch supports may be provided at the rear of the sections.

17 Claims, 9 Drawing Sheets

MINE TUNNEL SUPPORT SYSTEM

This application is a continuation-in-part application of pending U.S. Ser. No. 784,170, filed Oct. 28, 1991 now U.S. Pat. No. 5,176,474.

This invention relates to the support of mine tunnels and in particular to the temporary support of the roofs of mine tunnels whilst permanent supports are erected and to the provision of permanent supports.

Many mining methods require tunnels to be driven out from an access road. In the extraction of deep coal, two tunnels are normally driven out from the access road parallel to each other and some distance apart. At a later stage the two tunnels are joined by driving a tunnel between their ends and the coal between the two tunnels is extracted by one of a number of known methods.

In order to minimize costs and the amount of waste material produced, tunnels are generally driven within a coal seam. Coal extracted during the tunnelling is carried by an auxiliary conveyor or shuttle cars back to the main conveyor which is located in the access road. After mining has progressed for a certain distance, typically one meter, the mining machine is withdrawn to allow erection of a permanent support in the form of an arch and/or for bolts to be driven into the roof of the tunnel to support this. The length of tunnel which can be driven without providing for tunnel support is set by law and once this length has been reached, mining must cease and the machine be withdrawn until a permanent support, in whatever form this takes, has been put in place. Thus the formation of a tunnel proceeds by steps, each step consisting of a period of actual mining followed by a period in which the length of tunnel just formed is supported. Typically in Great Britain at present, each step of the mining operation takes forty minutes of which ten minutes is actually spent in excavation. The mining machines are therefore only occupied for 25% of the time, and often much less, and the mining operation takes at least four times as long as it would if the machinery were able to mine continuously.

One way of increasing the utilization of mining machines is by a method known as "multi-entry". In this method, once a length of a tunnel has been formed, the machine is withdrawn and set to driving or lengthening another tunnel whilst the just formed tunnel length is supported. The mining machine is thus continuously employed and producing coal but the rate of advance of any given set of tunnels is not increased.

Various arrangements which provide protection for workers and allow mining to continue whilst a permanent support is provided, have been suggested. In one arrangement, previously erected permanent supports have been employed to mount beams which in turn carry a protective cover over the area where mining is taking place. As mining progresses the covers are either replaced by permanent supports or connected with other parts to form a permanent support. Such arrangements are unwieldy and difficult to use underground, requiring many parts and a large number of workers to operate them satisfactorily.

In another suggested arrangement, a series of interconnected temporary supports are provided, which are moved forward, as mining proceeds, by advancing each support along the tunnel from the front.

As noted above, mine tunnel roofs may be supported by inserting bolts therein. This requires a hole to be drilled and then insertion of a bolt, together with a resin material, into the hole. The operation is relatively lengthy and may take up to three times as long as the time required to drive a tunnel of the maximum permitted unsupported length. This lengthy bolting operation is one of the factors which results in the present slow rate of tunnel advance. It is an object of the present invention to provide a method and apparatus for supporting a mine tunnel which overcomes these problems. In particular, it is an object to provide a method and apparatus which allows roof bolting to be accomplished more quickly than hitherto was possible.

In accordance with the invention, a method of supporting a mine tunnel comprises temporarily supporting the tunnel with a mine tunnel support system and permanently supporting the tunnel by inserting roof bolts in the roof thereof, the mine tunnel support system comprising a plurality of interconnected and spaced support sections arranged in one or more groups, each group comprising at least two sections, the first of which carries at least one first bolting machine in the form of a drill for forming a hole in the tunnel roof and the second of which is rearward of the first and carries at least one second bolting machine in the form of means for inserting a bolt in a hole in a tunnel roof and means which advance the support system along the tunnel, the method comprising the steps of forming a hole in the tunnel roof above the first section with the first bolting machine, advancing the system along the tunnel and then inserting a bolt in the already formed hole with the second bolting machine carried on the second section.

In accordance with the invention, a mine tunnel support system comprises a plurality of interconnected and spaced support sections arranged in at least one group, the group comprising at least two sections, the first of which carries at least one first bolting machine in the form of a drill for forming a hole in the tunnel roof and the second of which is rearward of the first and carries at least one second bolting machine in the form of means for inserting a bolt in a hole in the tunnel roof, and means which advance the support system along the tunnel by sequentially moving each section thereof along the tunnel, the arrangement being such that the first bolting machine(s) may be operated to form a hole, the system advanced and the second bolting machine(s) operated to insert a bolt in the previously formed hole.

With this arrangement, the bolting operation can be split into a number of stages, specifically the formation of a hole and the insertion of bolt into a previously formed hole, which stages can be carried out simultaneously. Thus, at a particular location, with the system stationary a hole can be formed and then, once the system has been advanced a bolt can be inserted into the hole. The time losses which occur during known bolting operations, in which the bolting is carried out as a single step, due to changing drill bits etc are therefore obviated. The time required for each section of tunnel formation is therefore considerably reduced.

In a preferred embodiment a third section, positioned intermediate the first and second sections, also carries at least one third bolting machine in the form of a drill for forming a hole in a tunnel roof. The length of hole which is required for a bolt is such that it is particularly suitably formed in two stages and by providing the means for carrying out these two drilling operations on two separate sections, the two operations can be carried out simultaneously at different locations. Thus, as the roof support system is advanced up a tunnel, at any particular location, a hole is first pre-drilled, the hole is then completed and a bolt is then inserted in the hole.

Suitably the bolting machines are carried on the support sections by brackets, the position of which on the sections can be varied. This allows bolts to be provided at any desired location across the tunnel roof. The lengths of the brackets or the position of the bolting machines thereon will depend on the type of the bolting machine carried thereby and will be set to bring the second and, if provided, third bolting machine(s) into a location previously occupied by the first bolting machine(s) as the system is advanced along a tunnel.

Preferably, the support system comprises at least, three spaced, interconnected support sections, each section including at least one bearing member which, when the section is in a first, loaded state, bears against the roof of the tunnel and, when the section is in a second, released state, is moved away from the bearing position, means for controlling movement of the bearing members, and drive means for changing the location of each support section when in the released state, the support system being advanceable along the tunnel in the forward direction in which mining is proceeding by operation of the control means to sequentially bring each section into the released state, commencing with the rearmost section, the drive means then moving the section into proximity with the next forward section, and thereafter to return the section to the loaded state.

The support system allows for continuous temporary support of a mine tunnel. As mining proceeds, the support system is advanced by sequentially moving each section thereof forward beginning with the rearmost section. Thus, the rear section, behind which a permanent support will have been provided, is released and moved up into a position in close proximity to the next forward support section. Only when the rearmost section is in the loaded position, in which it supports the section of the roof immediately thereabove, is the next section released and advanced in turn. This is continued until the forwardmost section is moved up into the freshly cut tunnel. The unsupported length whilst the front section is being moved up and fixed in the loaded position in the freshly cut tunnel will be no greater than the sum of the spacing between adjacent sections when the system is stationary, the "open" spacing, and the spacing between two adjacent sections when the rearmost thereof is brought into close proximity with the forwardmost thereof, the "closed" spacing. Furthermore, at all times during the system's advance, the length between an adjacent pair of loaded sections, when a section therebetween is being advanced, will be no greater than this sum, that is, no unsupported length of double the "open" spacing will be produced as is the case with known systems.

In the released state the bearing member may maintain contact with the roof of the tunnel, at a predetermined pressure, or be fully retracted to clear obstructions.

The support sections may comprise a beam carried on support legs, the support legs being in the form of hydraulic rams, the extension of which is controlled by the control means. Mine tunnels are sometimes not straight, and they may undulate depending on the direction of the coal seam which is being extracted The support system is capable of following such undulations by operation of the control means to give suitable differential extension of the legs of the sections to bring the system up or take it down as it is advanced forward.

The beams may carry a plurality of bearing members. The bearing members may be connected to the beams by extensible jacks. The support sections are moved into the loaded position by adjustment of the length of the support legs and/or the lengths of the jacks to bring the bearing members into contact with the tunnel roof. The bearing members of a particular support section may be evenly spaced along the beam thereof. The combined upwards force of the bearing members should be slightly less than the combined downward force of the legs. This ensures maximum bearing member contact with the roof, even distribution of load, and maximum headroom under the support section. The bearing members may be elongate members which extend along the tunnel. These serve to spread the load transmitted from the roof to each support section and facilitate advancement of the system since they provide a sliding surface and thereby help prevent snagging of an advancing section on the roof.

The beams are designed with a modulus of rigidity such that they will not bend under the maximum expected load from the tunnel roof. However, the beams are also preferably designed so that, if the roof load increases to a certain pre-set amount, the beams will plastically deform so that each section will collapse in a controlled fashion. Thus the system will be capable of coping with sudden convergence in a controlled and safe fashion.

Furthermore, means may be provided for automatically preventing advance of the system if the force exerted by the tunnel walls on any one of the support sections exceeds a certain preset maximum This could be, for example, if there was debris in the path of the support system or if the mining machine was not excavating a sufficiently wide tunnel. By preventing advance of the system once a safe working load is exceeded, damage thereto in such circumstances is prevented.

The connections between the support sections preferably comprise hydraulic arms which serve to move each section relative to the adjacent section(s) to advance the system. With this arrangement, the sections can be rapidly and easily advanced. At least two hydraulic rams are preferably provided between each pair of sections, one at either side, and the rams are arranged so that, by extending fully all the rams on one side and retracting fully all the rams on the other side, the support system can be turned through approximately 90°. This makes the support system very suitable for use with the type of mining method in which two tunnels are driven out and then joined up.

In a particularly preferred embodiment, each adjacent pair of support sections is connected by two connectors, each of which comprises two struts, each pivotally connected at one end to one of the support members and at the other end to the other strut, and a hydraulic ram secured between the struts. The advantage of this is that it permits the "open" distance to be much greater than the "closed" distance without requiring a long, expensive hydraulic ram. The scissor-type mechanism constituted by the two struts amplifies the movement of the ram. Furthermore, the struts can be arranged so that the force exerted thereby on a section which is being advanced is directed upwards at an angle which will assist the section in clearing obstacles on the tunnel floor lying in its path.

The rearmost and/or penultimate support section may carry an erection mechanism for raising up a partly formed support arch into a vertical position The erection mechanism may be arranged to pre-stress the arch. The power lines to the system for rams, jacks and the bolt machines thereof can also be used for the arch-lift mechanism. Furthermore, a single control system can be provided which controls both the advancement of the continuous temporary support, the bolting of the tunnel roof and the erection of permanent support arches for the tunnel. The system thus allows three distinct operations to be carried out with a single control and a single power supply and is therefore most practical and economical.

The invention will now further be described by way of example, with reference to the accompanying drawings in which.

Figure 1:
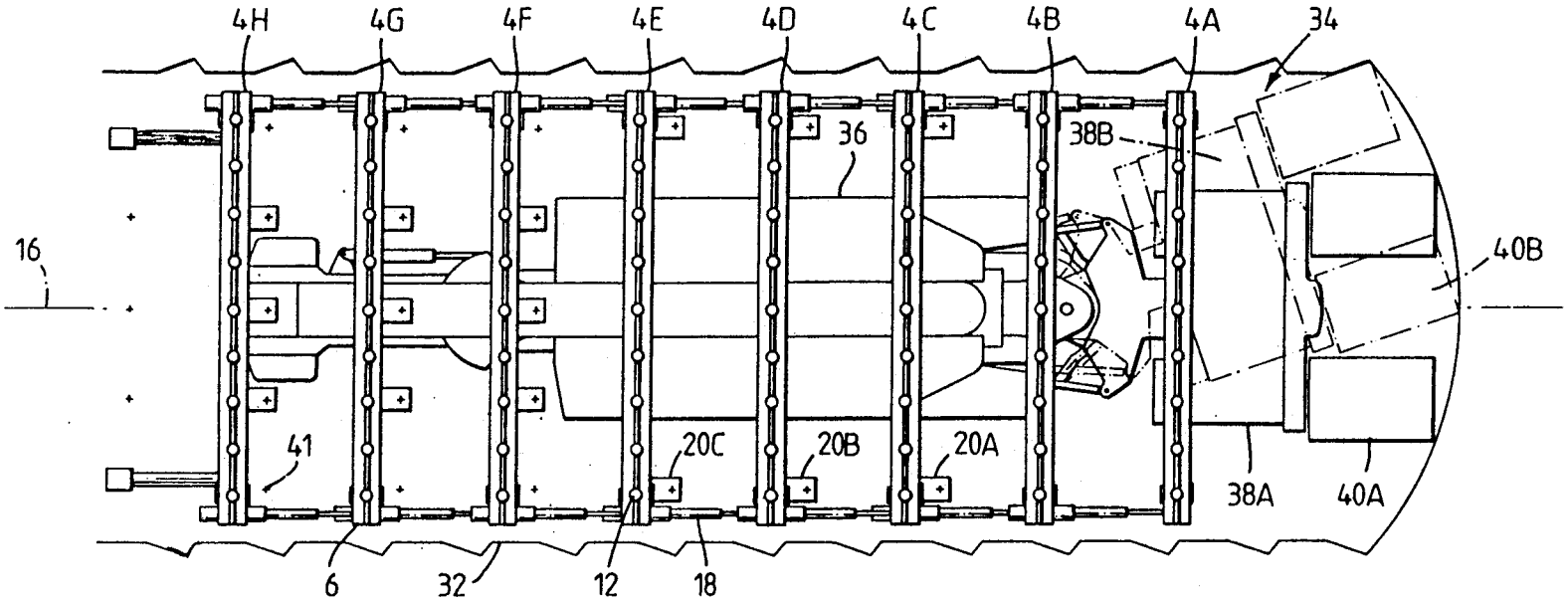
FIG. 1 is a schematic plan view of one embodiment of a mine tunnel support system in accordance with the invention.
Figure 2:
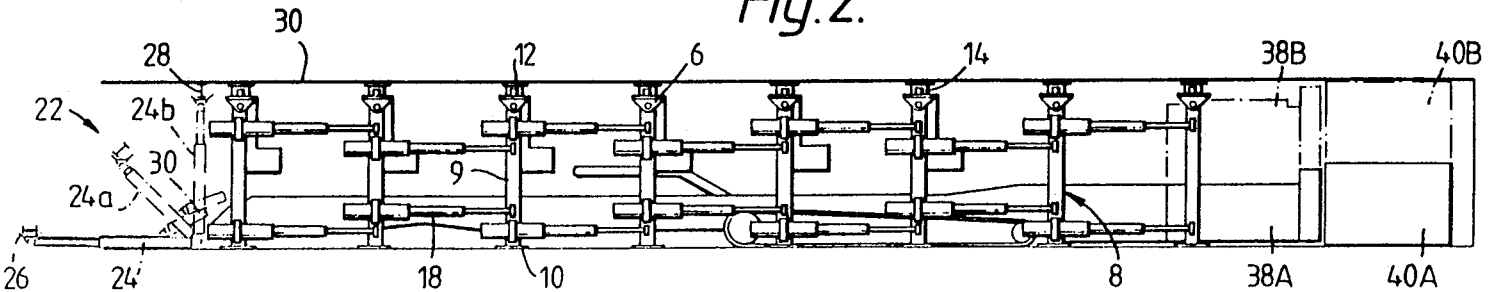
FIG. 2 is a side view of the support system of FIG. 1.

The support system 2 shown in FIGS. 1 and 2 comprises a plurality of support sections 4A–4H, each of which consists of a beam 6 and a pair of support legs 8. The support legs 8 are in the form of hydraulic rams 9 and include baseplates 10 at their lower end. The beams 6 carry a plurality of bearing members 12. The bearing members 12 are connected to the beams 6 by extensible jacks 14. The bearing members 12 are evenly spaced across the beams 6. The effective cylinder area of the jacks 14 is preferably set so that the sum of the effective thrust of the jacks 14 pushing up on the bearing members 12 is slightly less than the sum of the effective thrust of the rams 9 of the legs 8. The legs 8, when the rams 9 thereof are extended, will then tend to lift the beam 6 of the support section 4 until the first bearing member jack 14 thereof "bottoms" and will then stop since the hydraulic pressure exerted by the rams 9 and jacks 14 will be equal.

The support sections 4 of the support system 2 are interconnected by hydraulic rams 18, a pair of rams 18 being provided on each side of the support sections 4 and between each pair of sections 4. The rams 18 serve to connect and space the sections 4 of the support system 2 and by varying their length the support sections 4 may be moved relative each other.

A number of the beams 6 carry bolting machines shown schematically in FIGS. 1 and 2 at 20. These bolting machines 20 are operable to provide a permanent support for a tunnel by placement of bolts in the roof thereof The bolting machines 20 may be in the form of a first drill 20A, a second drill 20B and a bolt inserter 20C. The operation of the bolting machines 20A, 20B and 20C will be described further hereinafter. The mounts for the bolting machines 20 will also be further described below.

A lift mechanism 22 is attached to the support section 4H which is at the rear of the support system 2. The lift mechanism 22 comprises a ram 24 attached at one end to the rearmost section 4H of the support system 2. At the other end of the ram 24, a cradle 26 is attached. The cradle 26 is shaped to receive the crown beam, see 28, of an arch which has been partially formed behind the support system 2 on the ground. In the partially formed arch, the leg beams are loosely connected to the crown beam 28 and so can be brought together The arch is raised up by the retraction of a second ram 30 connected between the first ram 24 and the support system 2. As the first ram 24 and arch are raised up, the first ram 24 retracts. This intermediate stage is indicated in FIGS. 1 and 2 by the use of the suffix (a) for the relevant parts. Once the first ram 24 has reached a fully vertical position, it is again extended to raise the crown beam 28 of the arch up until it contacts the roof 30 of the mine tunnel. The leg beams of the arch can then be spread apart into contact with the walls 32 of the tunnel and fixed in position relative to the crown beam 28. This final position is shown in FIGS. 1 and 2 by use of the suffix (b) in relation to the relevant parts.

The support system 2 is employed to provide a continuous temporary support for a mine tunnel whilst this is being formed by a mining machine 34. The mining machine 34 shown in the Figures is of the type comprising a body 36 and a head 38 pivotally connected thereto. The head 38 carries a pair of augers 40. With the body 36 stationary, the head 38 is moved relative thereto from side to side, and up and down with the augers 40 rotating to extract coal. The head 38 and augers 40 are shown in the Figures both in their at rest positions, see 38A and 40A, and during the mining, see 38B and 40B. The support system 2 can equally well be employed with other types of mining machine, in particular, those in which the whole body of the machine moves as coal is mined. Coal extracted by the machine 34 is passed back along the machine to a position behind the support system 2 where it is received by a conveyor or shuttle cars.

The mining operation proceeds as a series of steps. Initially, the support system 2 is, as illustrated in FIGS. 1 and 2, fully extended so that the front section 4A thereof is located above the head 38 of the mining machine 34 with the distance between the front section 4A of the system 2 and the forward extremity of the head 34, that is, the length of tunnel which is unsupported, being the less than the minimum amount set by law. A controller (not shown) has caused the rams 9 of the legs 8 of the support sections 4 to extend and has also extended the jacks 14. By this movement the bearing members 12 have been forced against the roof 30 of the mine tunnel and so serve to support this. The portion of the tunnel behind the support system 2 has been secured by bolting or by erection of support arches. The rearmost section 4H can therefore be released without any fear of tunnel collapse.

The section 4H is released by retracting the jacks 14 and lowering the section by decreasing the height of the legs 8. The rams 18 between the section 4H and the next adjacent section 4G are then retracted to pull the section 4H into close proximity with section 4G. The section 4H is then returned to a loaded position by extension of the rams 9 of the legs 8 and of the jacks 14 to bring the bearing members 12 thereof into contact with the portion of the roof 30 of the tunnel thereabove. The tunnel is therefore supported in the region of the two sections 4G and 4H by the section 4H which means that the section 4G can in turn be released and moved forward.

The distance moved by each section 4 will be equal to the difference between the spacing between two adjacent sections 4 when the system 2 is stationary, the "open" spacing, and the spacing between two sections 4 brought into close proximity, the "closed" spacing.

This sequence of events is continued until the section 4B has been brought into proximity with the section 4A and returned to the roof supporting position. At this stage the mining machine 34 has bored out a new tunnel section and is ready to be moved forward. The machine 34 is advanced and the forwardmost section 4A is released, the region where it was standing being supported by the section 4B which has been brought into proximity with it. The section 4A is moved forward into the space created by the machine 34. The operation is then repeated.

Although shown in FIGS. 1 and 2 as following a straight line, mining tunnels can bend to the left and the right and the support system 2 accommodates this since the hydraulic rams 18 on either side of the system can be differentially set to cause it to turn as it is advanced forwards. In particular, if the rams 18 on one side are fully extended and those on the other side are fully retracted, the support system 2 is capable of turning a 90° corner within its own length.

During the initial driving of a tunnel, the rams 18 are all fully retracted to concertina the sections 4 of the system 2. Once the tunnel progresses the sections 4 can be progressively extended to provide support and allow bolting to take place.

The support system 42 of FIGS. 3 to 7 is similar to that of FIGS. 1 and 2 insofar as its basic components and principles of operation are concerned. Accordingly, like reference numerals will be used for like parts and only the differences will be discussed herebelow. The bolting machines 20 and their mounts of the support system 40 are not shown in FIGS. 3 to 7 for clarity.

Figure 3:
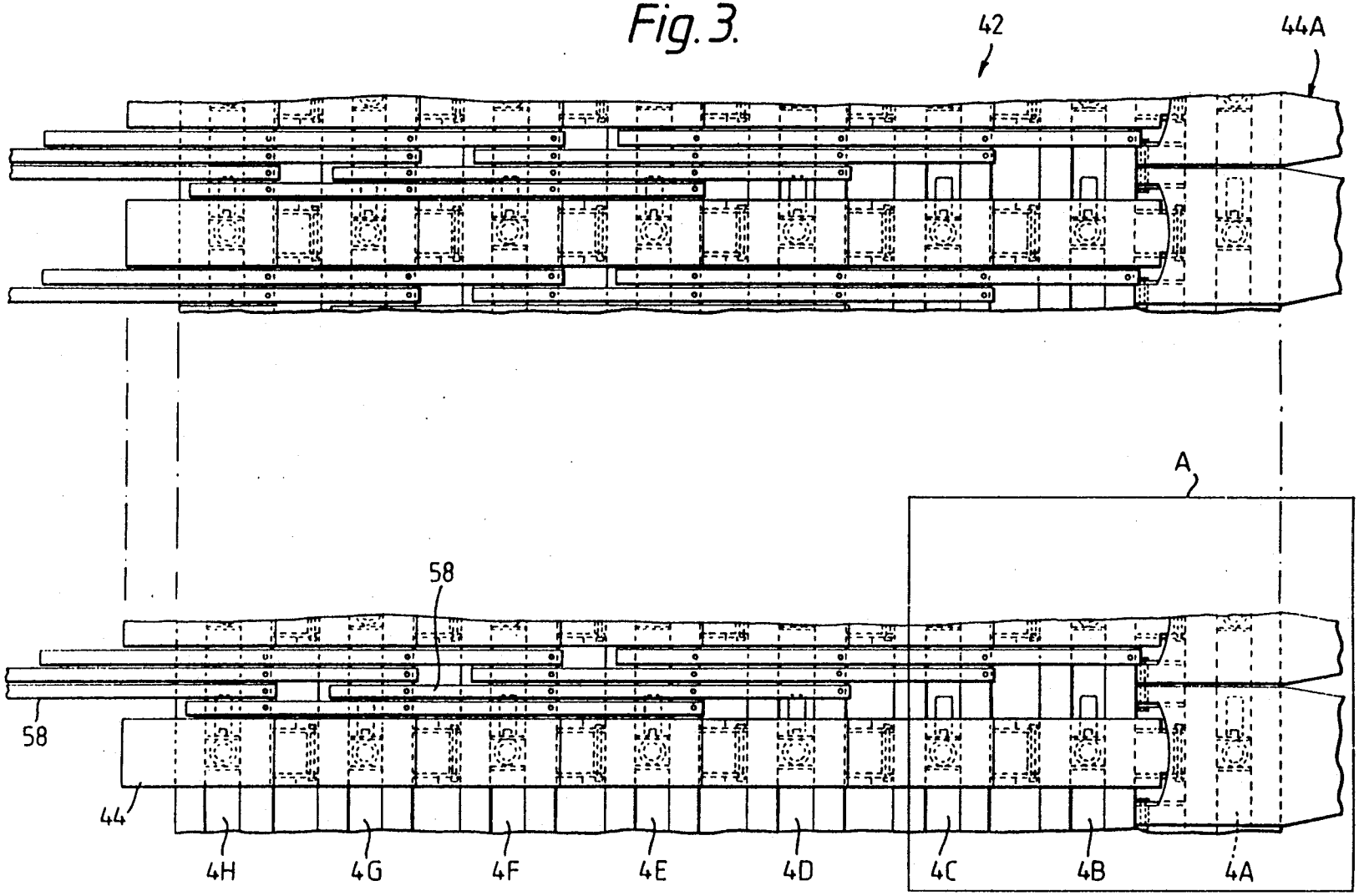
FIG. 3 is a plan view of part of a second embodiment of a mine tunnel support system in accordance with the invention.
Figure 4:
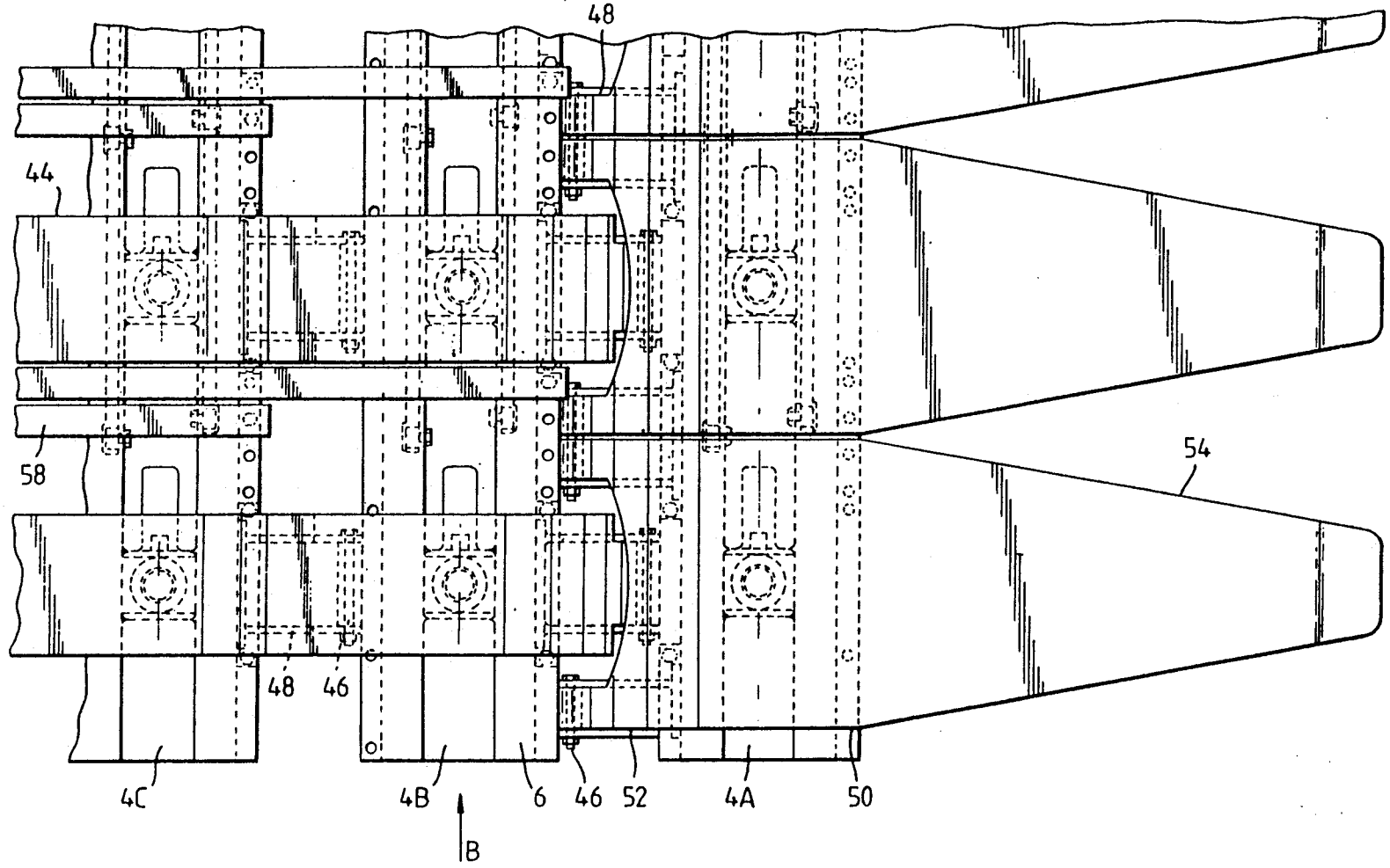
FIG. 4 is an enlarged view of the section of the support system in box A of FIG. 3.
Figure 5:
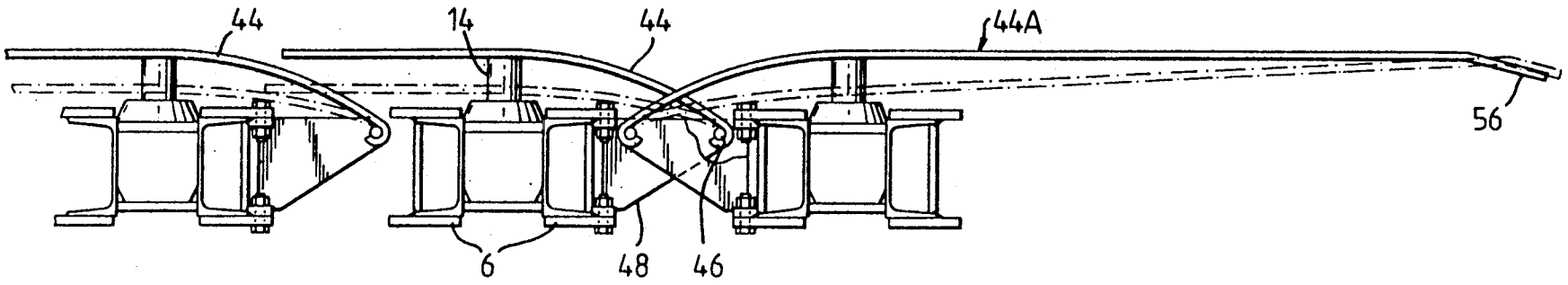
FIG. 5 is a view taken in the direction of arrow B of FIG. 4.
Figure 6:
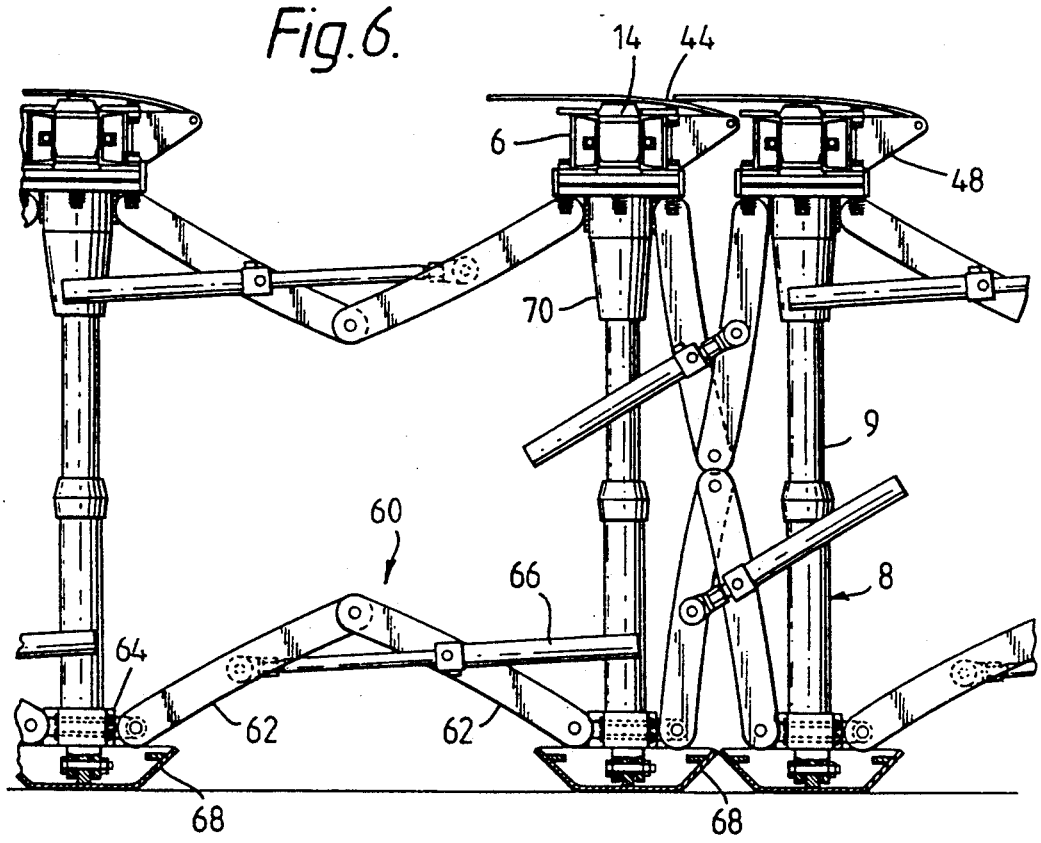
FIG. 6 is a side view of part of the mine tunnel support system of FIG. 3.
Figure 7:
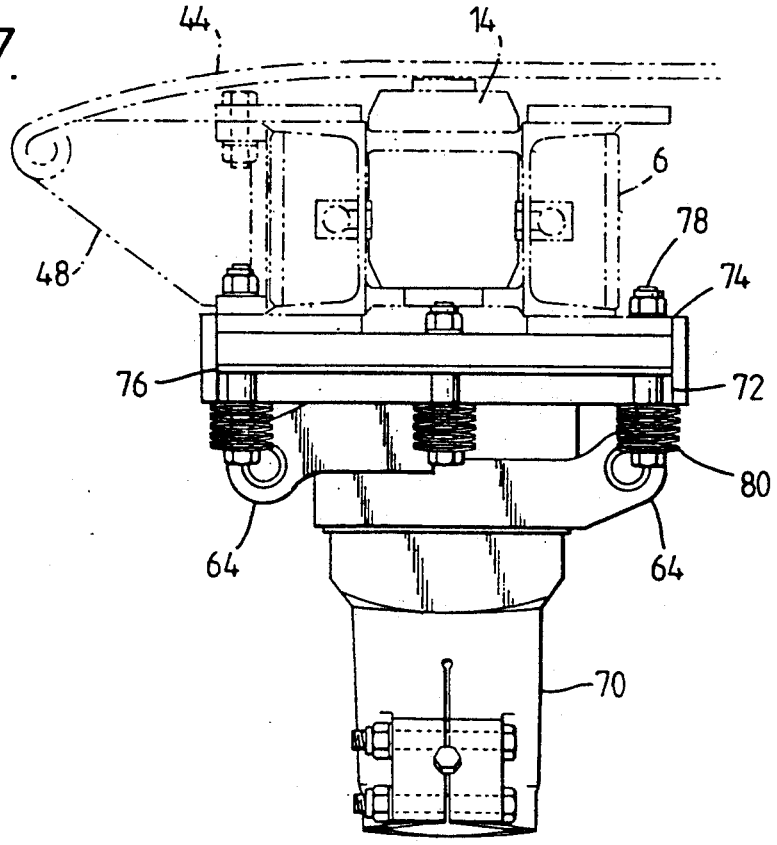
FIG. 7 is an enlarged view of the upper end of one of the support sections shown in FIG. 6.

FIGS. 3 to 5 show the upper portion of the support system 42 with the support sections 4A–4H thereof in the closed position As with the support system 2, each support section 4A–4H is provided with a plurality of bearing members spaced thereacross. However, the bearing members are in the form of elongate strips 44 attached at one end to a pin 46 which extends between two triangular mounting members 48. The triangular mounting members 48 are carried by and extend rearwardly of the beams 6 of the support sections 4A–4H. The bearing strips 44 extend from the pins 46, by which they are mounted, across the jack 14 associated therewith and forwardly so that, as illustrated in FIG. 5, when the support sections 4A–4H are in the closed position, the bearing strips 44 overlap. The bearing strips 44 are shown in FIG. 5 in full outline in the raised position with the jacks 14 extended, and in dotted outline in the lowered position, with the jacks 14 retracted.

The provision of a plurality of bearing members spread across each support section 4A–4H helps to spread the load supported by these. The use of the strips 44 as the bearing members increases this effect even further. Moreover, when advancing a particular support section 4A–4H, it is desirable to maintain some contact with the roof 30 of the mine tunnel. The legs 8 of the support sections 4A–4H are therefore lowered only to the extent necessary to allow the support sections 4A–4H to be pulled forwards with the bearing members thereof being dragged across the roof 30 of the mine tunnel. The bearing strips 44 facilitate this since their upper faces act as a sliding surface, the forward portion of which is inclined, so that they move easily across irregularities in the tunnel roof 30.

The forwardmost support section 4A is provided with bearing strips 44A which extend in the opposite direction to the bearing strips 44 of the other supports 4B–4H. The bearing strips 44A include a base portion 50 with two legs 52 extending therefrom by which they are mounted on the beam 6 of the support section 4A and which accommodate the bearing strips 44 of support section 4B therebetween. The width of the base section 50 of the bearing strips 44A is the maximum possible so that the base sections 50 together constitute an almost continuous shield across the beam 6 of the front support section 4A. The forward portion 54 of the bearing strips 44A are tapered and end in an inclined nose 56. The inclined nose 56 facilitates advancement of the support section 4A along the tunnel. The tapered portion 54 of the bearing strips 44A act as a shield which extends over the mining machine 34 and provides additional protection immediately thereabove.

As noted above, the bearing strips 44A have a base portion width such as to provide a continuous shield across the beam 6 of the forward support section 4A. This is possible because the support section 4A does not carry any bolting machines. The width of the bearing strips 44 of the other sections 4B–4H has, of necessity, to be less so that the bolting machines 20 can be accommodated therebetween. These sections 4B–4H are therefore provided with sprung steel plates 58 bolted to the forward edge of the beam 6 of one section 4B–4H and either trail backwards therefrom across the three sections therebehind, in the case of support sections 4B–4E, or trail backwards across the sections therebehind, if any, and extend rearwardly into the tunnel, in the case of support sections 4F–4H. As will be seen from FIG. 3, the plates 58 are staggered across the support sections 4A–4H so that, when these are in their closed positions, the plates 58 and bearing strips 44 together constitute a semi7continuous shield which is broken only by gaps at the locations of the bolting machines 20. Thus, the system 42 is protected from damage due to material falling from the roof 30 of the tunnel. In the open position of the support sections 4A–4H, the shield constituted by the plates 58 and bearing strips 44 will contain larger gaps, but it will still help prevent damage from any rubble falling from the roof 30 of the tunnel. To close the gaps, an expandable mesh may be attached across the bearing strips 44 and/or steel plates 58.

The legs 8 of the support sections 4A–4H of the system 42 are connected at their upper and lower ends to the legs 8 of the adjacent support sections 4A–4H by connectors 60. These connectors 60 comprise a pair of struts 62. One end of each strut is pivotally mounted to a leg 6 of a support section 4A–4H by way of a mounting ring 64 carried thereon. The two struts 62 are pivotally connected together at their other ends. A ram 66 is connected to both struts. As will be appreciated from FIG. 6, the connectors 60 act with a scissor-type action, the rams 66 in their retracted position pulling the struts 62 together, and in their extended position forcing these apart around the pivot connection therebetween. The advantage of the scissor action connectors 60 is that the struts 62 amplify the movement of the rams 66 between their retracted and extended positions which allows for a greater difference between the closed spacing of the support sections 4A–4H and the open spacing thereof. Furthermore, if the rams are mounted, as shown, so that the connection thereof to the forwardmost strut 62 of each pair is closer to the pivot point between the pair of struts 62, and the connection to the rearward most struts 62 of the pairs, the force on the rearward support section 4A–4H of the two connected by the connector 60 when this is advanced by retracting the rams 66, is upwardly directed. This will pull the feet 68 of the rearward support section which will help them move over any rubble on the mine floor. The shape of the feet 68 with their inclined facing edges also help with clearance of obstacles in a support section's path.

At the upper end of each leg 8, the ram 9 thereof is connected to a socket 70, around which the mounting rings 64 are located, which in turn is secured to a plate 72. The plate 72 is connected to a second plate 74 which carries the beam 6 of the support section 4A–4H. A pivot pin 76 is located between the plates 72 and 74 and these are secured together by bolts 78 which extend therethrough and carry cup washers 80 on their lower ends which bias the two plates 72 and 74 together The arrangement is such that any pressure on the leg 8 of the support section 4A–4H from the wall 32 of the tunnel tending to bend this inwardly will cause the socket 70 and plate 72 to pivot around the pivot pin 76 against the spring bias of the cup washers 80 away from the plate 74. A micro-switch, not shown, is provided between the plates 72 and 74 which is tripped when these are moved apart. The spring force of the cup washers 80 is set so that a certain predetermined maximum bending force on the legs 8 will overcome the spring bias provided by the cup washers 80 and move the plates 72 and 74 apart a distance sufficient to trip the micro-switch. The micro-switch, when tripped, prevents advancement of the support sections 4A–4H. If the force on the legs 8 of the support sections 4A–4H was due to the width of the tunnel being too narrow, the mining machine 34 can then be set to cut a wider tunnel. If, alternatively, it was due to an irregularity in the wall 32 of the tunnel, an operator can come and clean this down. The arrangement therefore prevents any damage to the legs 8, in particular, it prevents these from bending and possible consequent collapse of the system 42.

The rearwardmost support section 4H may have attached thereto a sledge 81. The sledge 81 can serve a number of purposes. Firstly, service supply ducts, for example, a ventilation duct 82, can be carried thereby into the front of the excavation. The upper surface of the sledge 81 can act as a work bench. Alternatively, it can provide a mounting facility for feeding and automatically erecting support arches between the rear support 4H and the sledge, as described further below.

As noted above, the ventilation duct 82 is preferably carried by the sledge 81. It is therefore fed into the tunnel from a low position and is subsequently raised to the more usual position therefor, in a top corner. The advantage of feeding the ventilation duct 82 into the tunnel near the floor thereof is that arches 83 can be assembled and/or erected thereabove. A coal conveyor, for removing coal from the mining face and out of the tunnel, can also be carried through the sledge 81.

Figure 8:
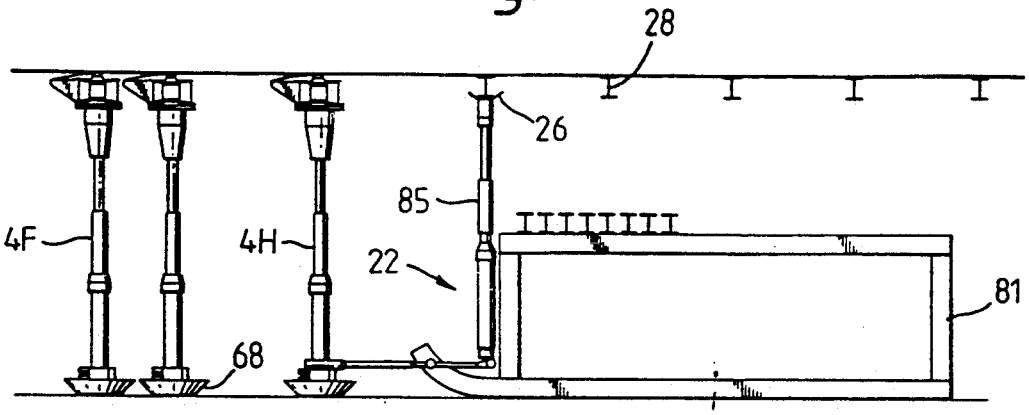
FIG. 8 is a side view of the rear end of the mine tunnel support system of FIG. 1 or FIG. 3.
Figure 9:
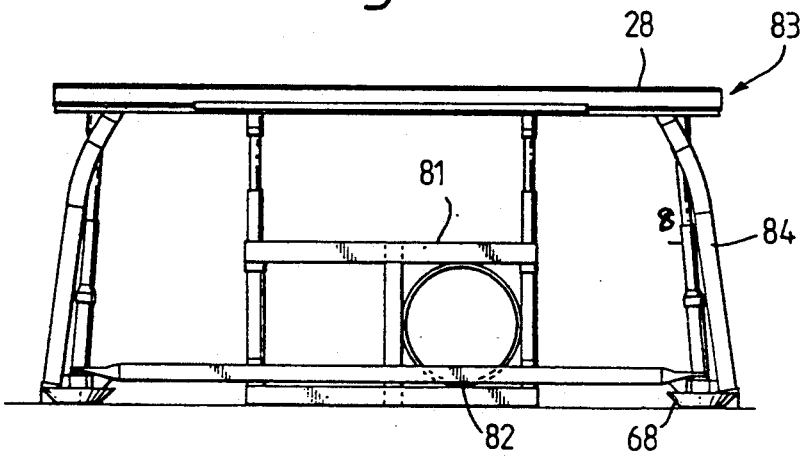
FIG. 9 is an end view of the mine tunnel support system end of FIG. 8.

The lift mechanism 22, shown in FIGS. 8 and 9, simply comprises a single vertical ram 85. Either the crown beam 28 of a pre-formed arch 83 is fed directly into the cradle 26 thereof from the sledge 81, or the crown beam 28 of an arch 83 constructed adjacent the sledge 81 from parts supplied thereby, is positioned in the cradle by an operator. The ram 85 then raises the arch 83 into place.

Figure 10:
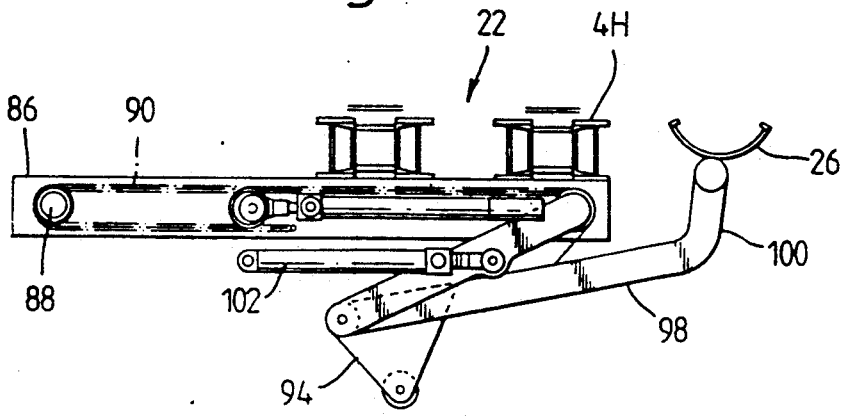
FIGS. 10, 11 and 12 are side views of an alternative arch lift mechanism to that shown in FIGS. 8 and 9 at different stages of the operation thereof.
Figure 11:
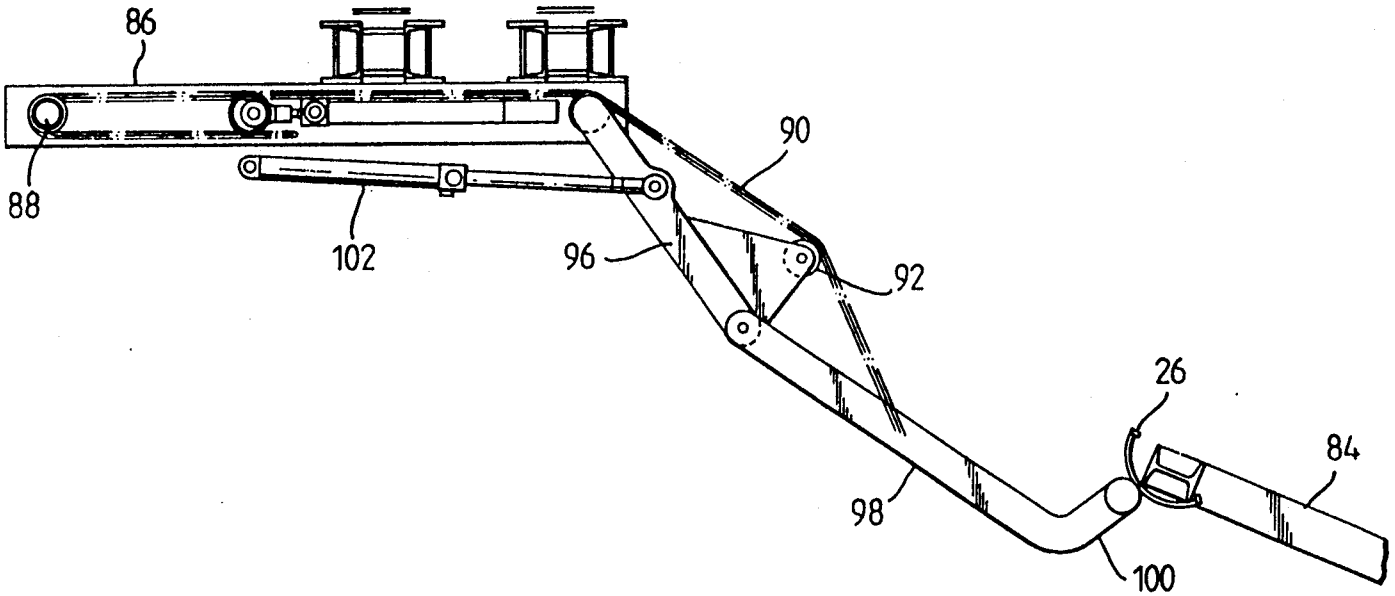
Figure 12:
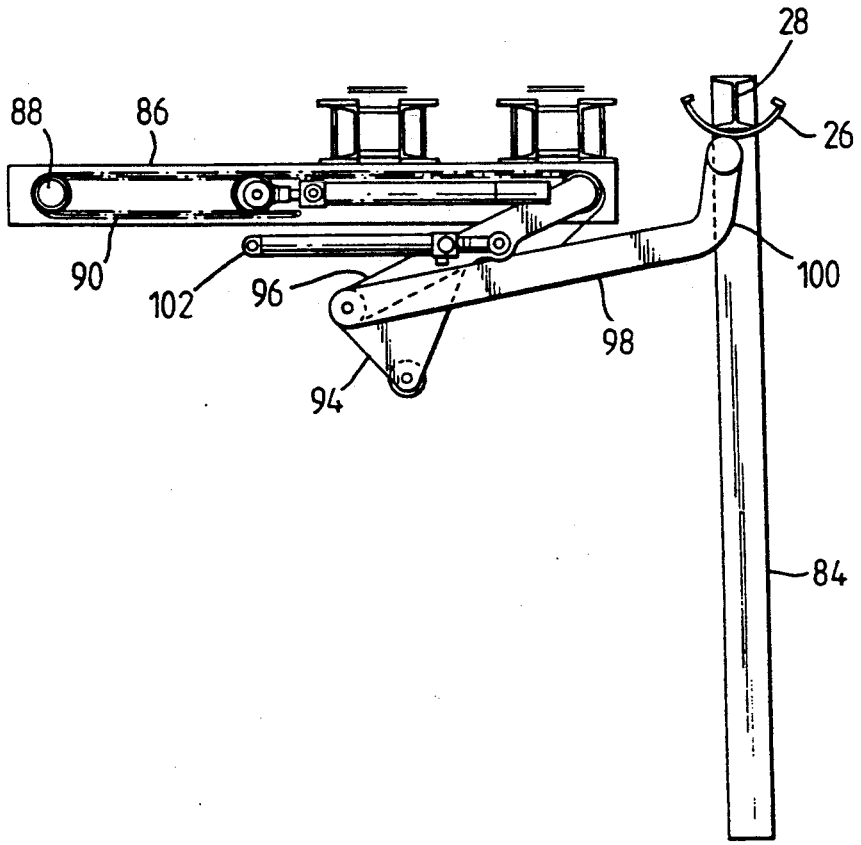

An alternative form of lift mechanism 22 is shown in FIGS. 10 to 12. This comprises a mount 86 secured to the rearwardmost section 4H on which is carried two pulleys 88 around which a pulley rope 90 extends. The pulley rope 90 passes from the pulleys 88 across a third pulley 92 carried on one corner of a triangular extension of a pivot arm 96 and is attached to a second pivot arm 98 which has an angled end 100 on which is mounted the cradle 26. A ram 102 is connected between base 86 and first pivot arm 96.

The lift mechanism 22 is shown in FIG. 10 in its initial position with the ram 102 fully retracted. In this posi7 tion, the pulley rope 90 is not in contact with the third pulley 92. When an arch 83 is to be erected, the ram 102 and pulley rope 90 are extended to move the pivot arms 96 and 98 into the position shown in FIG. 11. The crown beam 28 of an arch 83 is then positioned in the cradle 26 or is automatically fed thereinto by, for example, the indexing system discussed above.

The piston 102 may then be retracted to bring pivot arm 96 back to its original position but without shortening the pulley rope 90. This will cause the second pivot arm 98 to be pulled backwards, dragging the arch 83 therewith. The pulley rope 90 is then retracted to pull the second pivot arm 98 back to its initial position, thus raising the end 100 thereof and bringing the arch 83 into an upright position. This final position is illustrated in FIG. 12.

Alternatively, when the position shown in FIG. 11 is reached, the pulley rope 90 can simply be retracted, without retracting the ram 102 so lifting the pivot arm 98 and again raising the arch 28 into an upright position but at a location spaced further away from the mount 86.

Whatever form of lift mechanism 22 is employed, the arch 83 is preferably prestressed, that is, when it is moved into the upright position, the crown beam 28 bears upwards on the roof 30 of the tunnel. This is in contrast to the normal arrangement where the roof of the tunnel is allowed to sink onto the crown beam. The crown beam 28 can be initially slightly bowed and the lift mechanism 22 arranged to raise it up against the roof 30 with a force sufficient to cause bending of the beam 28 or even to bring it into a compressed state. The chance of roof subsidence is reduced by the use of prestressed arches.

As noted above, the beams 6 of the support system 2 or the support system 42 carry bolting machines shown schematically in FIGS. 1 and 2 at 20 and omitted, for the purposes of clarity, from FIGS. 3 to 12. As also noted above, the bolting machines 20 may be in the form of a first drill 20A, a second drill 20B and a bolt inserter 20C. In fact, identical devices may be employed for bolting machines 20A, 20B and 20C, provided, of course, they are capable both of gripping the drill bits necessary to drill holes in the mine roof and of holding the heads of roof bolts for insertion into the drilled hole. Such a device is described, for example, in U.S. Pat. No. 3811290 and in U.S. Pat. No. 4676697. The basic parts thereof are a drill pot with a motor mounted thereon which is drivably connected to a drill chuck rotatably mounted within the pot. Rotation is transmitted from the motor to the drill chuck to rotate a drill or a bolt carried therein. The device forming bolting machine 20A would be permanently provided with a first drill bit, that forming bolting machine 20B permanently provided with a second longer drill bit and that forming bolting machine 20C left empty ready for the heads of roof bolts to be inserted in the roof, for reasons which will be further explained hereinbelow.

Figure 13:
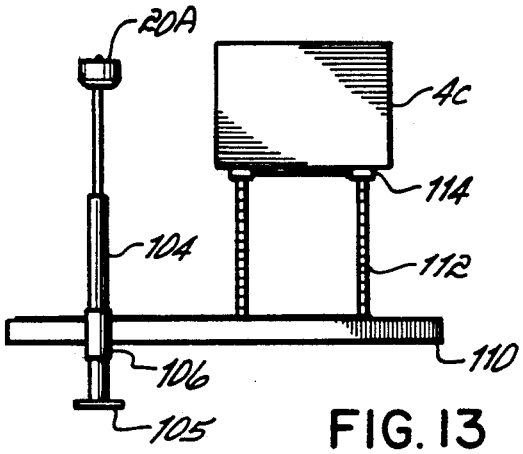
FIG. 13 is a schematic side view of one embodiment of a bolting device forming part of the support system of FIG. 1 or FIG. 3.

FIG. 13 shows schematically a support section 4C with one of the bolting machines 20A thereof. The bolting machine 20A will comprise a device of the type described in U.S. Pat. No. 3811290 or U.S. Pat. No. 4676697. The bolting machine 20A is mounted for verti7 cal movement thereof on a piston 104 connected to a bearing plate 106 that is movable into and out of engagement with the mine floor by extension and retraction of the piton 104 to brace the bolting machine 20A during the roof bolting operation. The piston 104 is secured to a carriage 106 which is supported for hori7 zontal movement along a guide-way 108 of a bracket 110 carried by the support section 4C via chains 112. The chains 112 may be connected to the support section 4C via a second carriage 114 movable axially along the base of the beam 6 of the support section 4C in guides secured thereto.

Figure 15:
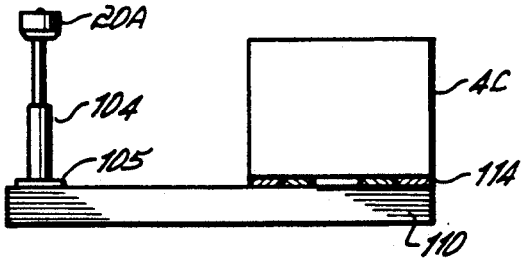
FIG. 15 is a schematic side view of a second embodi7 ment of a bolting device forming part of the support system of FIG. 1 or FIG. 3.
Figure 16:
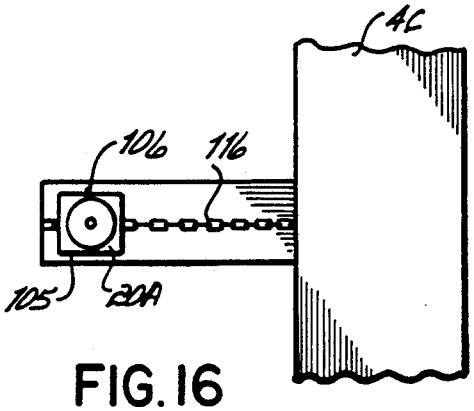
FIG. 16 is a plan view of the bolting device of FIG. 15.

FIGS. 15 and 16 show an alternative arrangement in which again the bolting machine 20A is carried on a piston 104. However in this case, the bearing plate 105 is connected directly to carriage 106 which is movable along bracket 110 via a chain 116. The bracket 110 in this embodiment is either connected directly to the beam 6 of the support section 4C or again a carriage 114 is provided therebetween to allow movement of the bracket 110 across the width of the beam 6.

Suitable motors are provided for carriages 106 and 114, not shown, and the hydraulic and electrical connections to these and to the piston 104 are all connected to a central control system for the support section 4C so that an operator can appropriately position bracket 110, piston 104 and bolting machine 20A. Alternatively, movement of carriages 106 and 114 may be achieved manually.

The roof bolting operation will now be described. This proceeds as a series of steps carried out whilst the system 2 or 42 is stationary. It is perhaps best understood and will be described with reference to system 2 of FIGS. 1 and 2, but it will be appreciated that substantially the same bolting operation is performed with the system 42 of FIGS. 3 to 7.

In the initial position shown in FIGS. 1 and 2 at support section 4C and at support section 4F, operators brace the bolting machines 20A by extending pistons 104. The bolting machines 20A which, as noted above, are permanently provided with first, short drill bits by extending pistons 104 are then operated to form short holes in the roof. The support system 2 is then advanced, which causes the sections 4D and 4G to occupy positions set back by an amount equal to the "closed" spacing from the positions previously occupied by sections 4C and 4F. The bolting machines 20B are paced in position below the previously formed holes by moving carriages 106. Operators on these sections can therefore operate the bolting machines 20B with their longer bits to extend out the previously formed holes. Once the system 2 has been advanced by another step the sections 4E and 4H will occupy positions set back by an amount equal to twice the "closed" spacing from the positions previously occupied by sections 4C and 4F. The bolting machines 20C are moved below the holes and operators on these sections can then insert rock bolts into the holes.

As an alternative to providing movable carriages 106 for bolting machines 20B and 20C, these can simply be fixed in place relative the brackets 110. In this case, the distance between the horizontal position of bolting machine 20A on its bracket 110 and that of bolting machine 20B on its bracket 110, must be made equal to the "closed" spacing, the difference between the horizontal position of the bolting machine 20A along bracket 110 and that of bolting machine 20C along bracket 110 must be made equal twice the "closed" spacing This will automatically bring the bolting machines 20B and 20C into the positions previously occupied by bolting machine 20A as the system 2 is advanced along the tunnel.

Thus, if the bolting machines 20 are provided at the rear of the sections 4, the bolting machine 20A will be positioned furthest away therefrom with the bolting machines 20B and 20C being progressively closer thereto. If, on the other hand, as shown in FIG. 1, they are provided at the front of the sections, the bolting machine 20A will be closest to the sections with the bolting machines 20B and 20C progressively further away therefrom.

As mining progresses, therefore, and the system 2 is advanced, bolt holes are continuously being opened, completed, and bolts being inserted into the completed holes. Since the bolt machines 20 on a particular section only perform one function they do not need to have their bits changed and no time is lost. Furthermore, whilst the group of sections 4C, 4D and 4E serve to support bolting machines 20 for inserting two bolts in the tunnel roof at either side thereof, the group of sections 4F, 4G and 4H serve to support bolting machines 20 for inserting three bolts between the two previously inserted bolts. This is more efficient than if all five bolts were to be inserted in one step by a single group of sections. The position of previously inserted bolts is shown on the Figures by crosses 41.

The provision of carriages 114 which can be moved horizontally across the width of the beams 6 of the support section 4 means that the bolting machines can be located at any desired positions across the width of the roof of a mine tunnel with which the support system 2 is employed.

Figure 14:
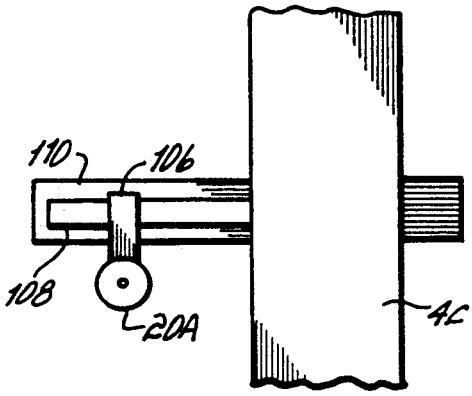
FIG. 14 is a plan view of the bolting device of FIG. 13.

To prevent the brackets 110 of the various bolting machines 20A, B and C impacting as the system 2 is advanced, they can be provided on every alternative support section 4 rather than on each adjacent support section 4, as shown in FIG. 1. Alternatively, with the arrangements shown in FIG. 13 and 14, the brackets can be spaced by having chains 112 of different lengths for successive sections 4C, 4D, 4E and 4F, 4G, 4H. With the arrangement of FIGS. 15 and 16, the connection between the brackets 110 and the carriage 114 could be made rotary such that the bracket 110 can be angled to the side when bolting is not required.

The bolting operation can be modified in a number of ways. In particular, it may be desirable to split down even further the bolting operation and make it consist of four or more stages. In this case the number of sections in a group for performing a single bolting operation would be correspondingly increased. The length of the support system 2, that is, the number of support sections therein, could also be increased. If the number of sections required for a particular bolting operation was increased as described above then the overall number of sections would also preferably be increased so that two bolting operations could still be carried out simultaneously. Furthermore, the number of sections in the system could be increased to provide three or more groups thereof, each group performing a single bolting operation. Alternatively, or additionally, the number of bolts inserted by a particular group of sections could be increased simply by increasing the number of bolting machines carried on each section in the group. The length of the support system 2 would also be varied depending on the type of mining machine employed.

The support system 2 therefore provides not only a temporary support for a mining machine 31 but also allows the production of a tunnel support in the form of roof bolts in a rapid and simple fashion. Moreover, the system 2 includes a lift mechanism 22 so that arch supports can be provided in addition to the roof bolts. A single control system can be employed to control all the parts and hence all the separate operations carried out by the support system 2. Furthermore, only a single power supply is required to achieve all three operations. The support system 2 is therefore very economical and practical.

I claim:

1. A method of supporting a mine tunnel comprising temporarily supporting the tunnel with a mine tunnel support system and permanently supporting the tunnel by inserting roof bolts in the roof thereof, the mine tunnel support system comprising a plurality of interconnected and spaced support sections arranged in one or more groups, each group comprising at least two sections, the first of which carries at least one first bolting machine in the form of a drill for forming a hole in the tunnel roof and the second of which is rearward of the first and carries at least one second bolting machine in the form of means for inserting a bolt in a hole in a tunnel roof and means which advance the support system along the tunnel, the method comprising the steps of forming a hole in the tunnel roof above the first section with the first bolting machine, advancing the system along the tunnel and then inserting a bolt in the already formed hole with the second bolting machine carried on the second section.

2. A method as claimed in claim 1 wherein the mine tunnel support system includes a third section located intermediate the first and second sections which carries at least one third bolting machine in the form of a drill, the third bolting machine having a drill bit longer than that of the first bolting machine, the method comprising the additional step subsequent to forming a hole with the first bolting machine of advancing the system along the tunnel and lengthening the already formed hole with the third bolting machine carried on the third section.

3. A mine tunnel support system comprising a plurality of interconnected and spaced support sections arranged in at least one group, the group comprising at least two sections, the first of which carries at least one first bolting machine in the form of a drill for forming a hole in the tunnel roof and the second of which is rearward of the first and carries at least one second bolting machine in the form of means for inserting a bolt in a hole in the tunnel roof, and means which advance the support system along the tunnel by sequentially moving each section thereof along the tunnel, the arrangement being such that the first bolting machine(s) may be operated to form a hole, the system advanced and the second bolting machine(s) operated to insert a bolt in the previously formed hole.

4. A mine tunnel support system as claimed in claim 3 wherein a third section located intermediate the first and second sections carries at least one third bolting machine in the form of a drill.

5. A mine tunnel support system as claimed in claim 3 wherein the bolting machines are carried on the support sections by brackets, the connection between the bolting machines and the brackets being via a carriage movable along the bracket so as to change the distance between the bolting machine and the support section.

6. A mine tunnel support system as claimed in claim 3 wherein the system is advanced by sequentially moving each section thereof forwards into a position adjacent the next forward section and wherein the bolting machines are carried on the support sections by brackets to which they are fixed and which serve to space them from the sections, the difference between the spacing between the at least one first bolting machine and the support section on which it is carried and the spacing between the at least one second bolting machine and the support on which it is carried being a multiple of the difference between the spacing between the sections when they are spaced apart and that when they are adjacent each other during advance of the system.

7. A mine tunnel support system as claimed in claim 4 wherein the bolting machines are carried on the support sections by brackets, the connection between the bolting machines and the brackets being via a carriage movable along the bracket so as to change the distance between the bolting machine and the support section.

8. A mine tunnel support system as claimed in claim 4 wherein the system is advanced by sequentially moving each section thereof forwards into a position adjacent the next forward section and wherein the bolting machines are carried on the support sections by brackets to which they are fixed and which serve to space them from the sections, the difference between the spacing between the at least one first bolting machine and the support section on which it is carried and the spacing between the at least one second bolting machine and the support on which it is carried being a multiple of the difference between the spacing between the sections when they are spaced apart and that when they are adjacent each other during advance of the system.

9. A mine tunnel support system as claimed in claim 8 wherein the difference between the spacing of the at least one first bolting machine from the section on which it is carried and the spacing between the at least one third bolting machine and the section on which it is carried is equal to a multiple of the difference between the distance between the sections when spaced and that when they are adjacent each other during advance of the system.

10. A mine tunnel support system as claimed in claim 3 in which the bolting machines are carried on the sections via extensible rams.

11. A mine tunnel support system as claimed in claim 3 wherein the position of the bolting machines across the width of the sections on which they are carried can be varied.

12. A mine tunnel support system as claimed in claim 3 wherein the support sections each comprise a beam carried on support legs, the support legs including hydraulic rams.

13. A mine tunnel support system as claimed in claim 3 wherein the connections between the support sections comprise hydraulic rams, at least two rams being provided between each adjacent pair of sections.

14. A mine tunnel support system as claimed in claim 3 wherein each adjacent pair of support sections is connected by a pair of connectors, each of which comprises two struts, each pivotally connected at one end to one of the support sections and at the other end to the other strut, and a hydraulic ram connected between the struts.

15. A mine tunnel support system as claimed in claim 3 wherein means are provided for automatically preventing advance of the system if the force exerted by the tunnel walls on any one of the support sections exceeds a certain preset maximum.

16. A mine tunnel support system as claimed in claim 3 wherein the rearmost and/or penultimate section carries a mechanism for erecting permanent arch supports.

17. A mine tunnel support system as claimed in claim 3 wherein a service member is connected to one or more of the support sections which advances with, but behind, the sections.

* * * * *

UNITED STATES PATENT AND TRADEMARK OFFICE

CERTIFICATE OF CORRECTION

PATENT NO. : 5,306,099

DATED : April 26, 1994

INVENTOR(S) : Benjamin Mason

It is certified that error appears in the above-indentified patent and that said Letters Patent is hereby corrected as shown below:

At Column 7, line 60 please insert after "position" a --.--
At Column 5, line 46 please delete "7" and insert -- - --
At Column 8, line 60 please delete "7" and insert -- - --
At Column 10, Line 32 please delete "7" and insert -- - --
At Column 11, line 27 please delete "7" and insert -- - --
At Column 11, line 33 please delete "7" and insert -- - --

Signed and Sealed this

Twenty-fifth Day of April, 1995

*Attest:*

Bruce Lehman

BRUCE LEHMAN

*Attesting Officer*

*Commissioner of Patents and Trademarks*